US005559539A

United States Patent [19]

Vo et al.

[11] Patent Number: 5,559,539

[45] Date of Patent: Sep. 24, 1996

[54] INK JET RECORDING APPARATUS HAVING SELF ALIGNING PRINT HEAD CLEANING SYSTEM AND METHOD OF OPERATING THE PRINT HEAD CLEANING SYSTEM

[75] Inventors: Giang Vo, Moorpark; Akihiro Okada, Agoura Hills, both of Calif.

[73] Assignee: Dataproducts Corporation, Simi Valley, Calif.

[21] Appl. No.: 136,111

[22] Filed: Oct. 12, 1993

[51] Int. Cl.[6] ..... B41J 2/165

[52] U.S. Cl. ..... 347/33; 15/256.5

[58] Field of Search ..... 347/22, 29, 30, 347/31, 32, 33; 355/299; 15/256.5, 250.32, 250.33, 250.15, 250.19, 250.2; 198/499

[56] References Cited

U.S. PATENT DOCUMENTS

| | | | |
|---|---|---|---|
| 3,945,020 | 3/1976 | Kraus et al. | 347/30 |
| 4,112,435 | 9/1978 | Kattner et al. | 347/33 |
| 4,123,761 | 10/1978 | Kimura et al. | 347/30 |
| 4,144,537 | 3/1979 | Kimura et al. | 347/31 |
| 4,169,298 | 10/1979 | Smith | 15/250.33 |
| 4,306,245 | 12/1981 | Kasugayama et al. | 347/33 |
| 4,364,065 | 12/1982 | Yamamori et al. | 347/28 |
| 4,371,881 | 2/1983 | Bork et al. | 347/29 |
| 4,401,990 | 8/1983 | Aiba et al. | 347/33 |
| 4,436,439 | 3/1984 | Koto | 347/29 X |
| 4,450,456 | 5/1984 | Jekel et al. | 347/29 |
| 4,479,136 | 10/1984 | Lewis et al. | 347/33 |
| 4,543,589 | 9/1985 | Terasawa | 347/31 |
| 4,556,894 | 12/1985 | Terasawa | 347/30 |
| 4,791,437 | 12/1988 | Accattino et al. | 347/28 X |
| 4,853,717 | 8/1989 | Harmon et al. | 347/29 |
| 4,951,066 | 8/1990 | Terasawa et al. | 347/33 |
| 4,959,673 | 9/1990 | Noda | 347/33 |
| 4,970,535 | 11/1990 | Oswald et al. | 347/25 |
| 5,018,884 | 5/1991 | Hirano et al. | 347/24 |
| 5,065,158 | 11/1991 | Nojima et al. | 347/33 |
| 5,126,765 | 6/1992 | Nakamura . | |
| 5,379,061 | 1/1995 | Yamagushi et al. | 347/30 |

FOREIGN PATENT DOCUMENTS

| | | | |
|---|---|---|---|
| 55-156071 | 12/1980 | Japan | 347/29 |
| 57-61574 | 4/1982 | Japan . | |
| 57-80064 | 5/1982 | Japan . | |
| 57-116655 | 7/1982 | Japan . | |
| 58-94472 | 6/1983 | Japan . | |
| 59-14964 | 1/1984 | Japan . | |
| 59-83664 | 5/1984 | Japan . | |
| 59-164149 | 9/1984 | Japan . | |
| 61-230949 | 10/1986 | Japan . | |

*Primary Examiner*—John E. Barlow, Jr.
*Attorney, Agent, or Firm*—Loeb & Loeb

[57] ABSTRACT

An ink jet apparatus including a recording head having a jetting surface, an actuator positioned adjacent to the jetting surface, and a cleaning blade member coupled to the actuator by a self-aligning system. The actuator is adapted to move the wiping blade between a cleaning position in which the blade comes in contact with the jetting surface for wiping and a retracted position in which the wiping blade is separated from the jetting surface. The self-aligning system automatically aligns the edge of the blade substantially in parallel with the jetting surface in the cleaning position.

17 Claims, 4 Drawing Sheets

INK JET RECORDING APPARATUS HAVING SELF ALIGNING PRINT HEAD CLEANING SYSTEM AND METHOD OF OPERATING THE PRINT HEAD CLEANING SYSTEM

BACKGROUND OF THE INVENTION

1. Field of the Invention

This invention relates to an ink jet recording apparatus and method and, in particular embodiments, to such an apparatus and method with a head cleaning system for cleaning the ink jetting surface or surfaces of an ink jet head.

2. Related Art

Ink jet recording devices have become increasingly more popular as the demand for high speed, high quality printing increases. Typical ink jet devices include a print head having one or more jetpacks, each having a Jetting surface (or orifice surface). A jetting surface is typically provided with one or more orifices through which ink (or other suitable medium) is selectively expelled.

However, in both solid ink or liquid ink jet recording devices, debris and excess residual ink tends to accumulate on the jetting surface of an orifice plate. Such accumulations often lead to jet outages and, therefore, faulty printing. A jet outage can occur when a piece of debris lands across an orifice or an excessive buildup of ink interferes with the jetting action through the orifice.

Another common cause of jet outages is a failure to provide or maintain a suitable meniscus formation at the orifice. Many ink jet devices require a suitable formation of ink meniscus at each jetting surface orifices to provide proper hydraulic action and, thus, desired ink droplet formations. The break-up of this meniscus formation can cause depriming of the system. Such meniscus formation tends to be interrupted from time-to-time, during printing operations, e.g., by air bubbles, or other environmental factors.

In order to remove unwanted material on the orifice surface, some ink jet printers have been equipped with a feature where an operator can clean the surface by either vacuum purging, pressure purging and/or wiping with an absorbent medium. However, such orifice cleaning methods that use either a vacuum or pressure source tend to waste significant amounts of ink during purging processes.

Along with the purging system, some printers utilize paper or absorbent media to blot out or wipe off debris and residual ink off the orifice surface. Yet other systems use a bin or tray that collects waste ink. These systems typically require an operator to initiate the cleaning process and then discard the wasted byproducts. As a result, printing may need to be interrupted for the operator initiated cleaning process, ink and/or other consumable material may be wasted, and the costs associated with each of the above and with the discarding of the waste material are incurred. Moreover, the vacuum, pressure and blotting type actions may increase the chance of meniscus breakdowns, resulting in jet outages.

Other ink jet apparatuses have employed a cleaning blade for cleaning the jetting surface of the ink jet head. With the blade arranged in a fixed location, the ink jet head is moved past the blade so that the blade wipes the jetting surface with the head motion. However, the blade can be (or can become) misaligned with the ink jet head such that the blade surface fails to sufficiently contact the entire orifice surface or applies a varying degree of pressure across the orifice surface. Thus, an unaligned blade may not sufficiently remove excess ink or debris from the ink jet head and, in some instances, may even channel excess ink or debris to various locations on the print head, creating build-ups or pooling at such locations.

In addition, these systems typically provide for head cleaning only after an ink jet outage has occurred or provide for wiping operations relatively often which can result in excessive blade wear. Moreover, the blade tends to abrade and tatter after prolonged use, resulting in an ineffective and inefficient cleaning process.

SUMMARY OF THE DISCLOSURE

It is an object of embodiments of the present invention to provide an ink jet apparatus and head cleaning system and method which avoids, for practical purposes, the above noted operational limitations of the prior art.

Embodiments of the present invention further relate to a head cleaning system for cleaning the jetting surface (or orifice surface) of a jet head and a method of operating the cleaning system in a manner which improves the reliability and efficiency of an ink jet apparatus. Further embodiments of the present invention employ a cleaning blade capable of self-aligning with the jetting surface.

According to a preferred embodiment of the present invention an ink jet apparatus includes, generally, a recording head having at least one orifice plate provided with a jetting surface (or orifice surface), an actuator positioned adjacent to the jetting surface, and a cleaning blade member coupled to the actuator by a self-aligning system. In further embodiments, the recording head includes multiple jetpacks, each of which includes at least one orifice plate provided with a jetting surface. For example, a color jetpack (for jetting colored inks) may be disposed above a black ink jetpack in the recording head. The actuator may be a solenoid adapted to selectively move the cleaning blade member between a cleaning position, in which the blade member comes in contact with the jetting surface(s), and a retracted position, in which the blade member is separated from the jetting surface(s).

In preferred embodiments, the recording head is moveable relative to a recording medium (e.g., a sheet of paper). The movement of the recording head, while the blade is in contact with the jetting surface(s), effects a wiping action of the blade across the jetting surface(s). Preferably, the jetting surface(s), and thus the rows of orifices along the jetting surface, are at an angle (for example, about $8^{o}$) with respect to the direction of motion of the recording head. The angle of the row of orifices is selected for proper ink dot registration, in accordance with well known principles. However, when the blade is in contact with an angled jetting surface, movement of the recording head imparts a force component on the blade directed transverse to the direction of motion of the recording head. This force component tends urges the blade in a direction transverse to the direction of motion of the recording head. As discussed below, a self-aligning system allows the blade to remain aligned with the jetting surface, even if the blade moves slightly in a direction transverse to the recording head motion direction.

Embodiments of the invention provide a self-aligning system which automatically aligns the edge of the blade substantially in parallel with the jetting surface, upon the blade being moved to the cleaning position. In addition, the self-aligning system provides improved wiping action for angled orifice plates, wherein a force transverse to the recording head direction of motion is imparted on the wiper blade as the recording head is moved relative to the wiper blade. The self-aligning system, according to a preferred embodiment of the invention, includes a double pivot joint adaptor which is pivotally coupled, about a first pivot joint, to the plunger of the actuator solenoid and pivotally coupled, about a second pivot joint, to the blade member. A coil spring biases the blade member toward the orifice surface, such that the combination of the coil spring bias and the pivot joints provide, in effect, a floating (or semi-floating) blade member which automatically aligns, and maintains alignment, with the surface (the orifice surface) against which it is pressed.

Further embodiments provide a control system for controlling the cleaning blade actuator so as to move the cleaning blade member to the cleaning position during the time interval when a sheet of paper is being fed into its printing position, so as to avoid interrupting the normal printing operation. According to further embodiments, the control system operates to move the cleaning blade member to the cleaning position at a rate of once every X number of sheets, wherein X is within the range of 10 and 30 and, preferably, is 25. This rate has been found to avoid approximately 90% of jet outages which would otherwise be caused by ink or debris build-up on the orifice surface or meniscus formation failure, while maintaining a relatively large operational life of the cleaning blade member.

These and other objects and advantages of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

DETAILED DESCRIPTION OF PREFERRED EMBODIMENTS

While embodiments of the present invention are described with reference to an ink jet apparatus for selectively jetting ink droplets onto recording media, it will be understood that further embodiments of the invention are applicable to other types of jetting apparatus which expel droplets, streams, or other formations of any appropriate jettable material, including inks, cleaning agents, adhesives, or the like. However, for purposes of simplifying the present disclosure, the embodiments discussed below primarily refer to ink jet apparatuses and jetting of ink droplets.

Figure 1:
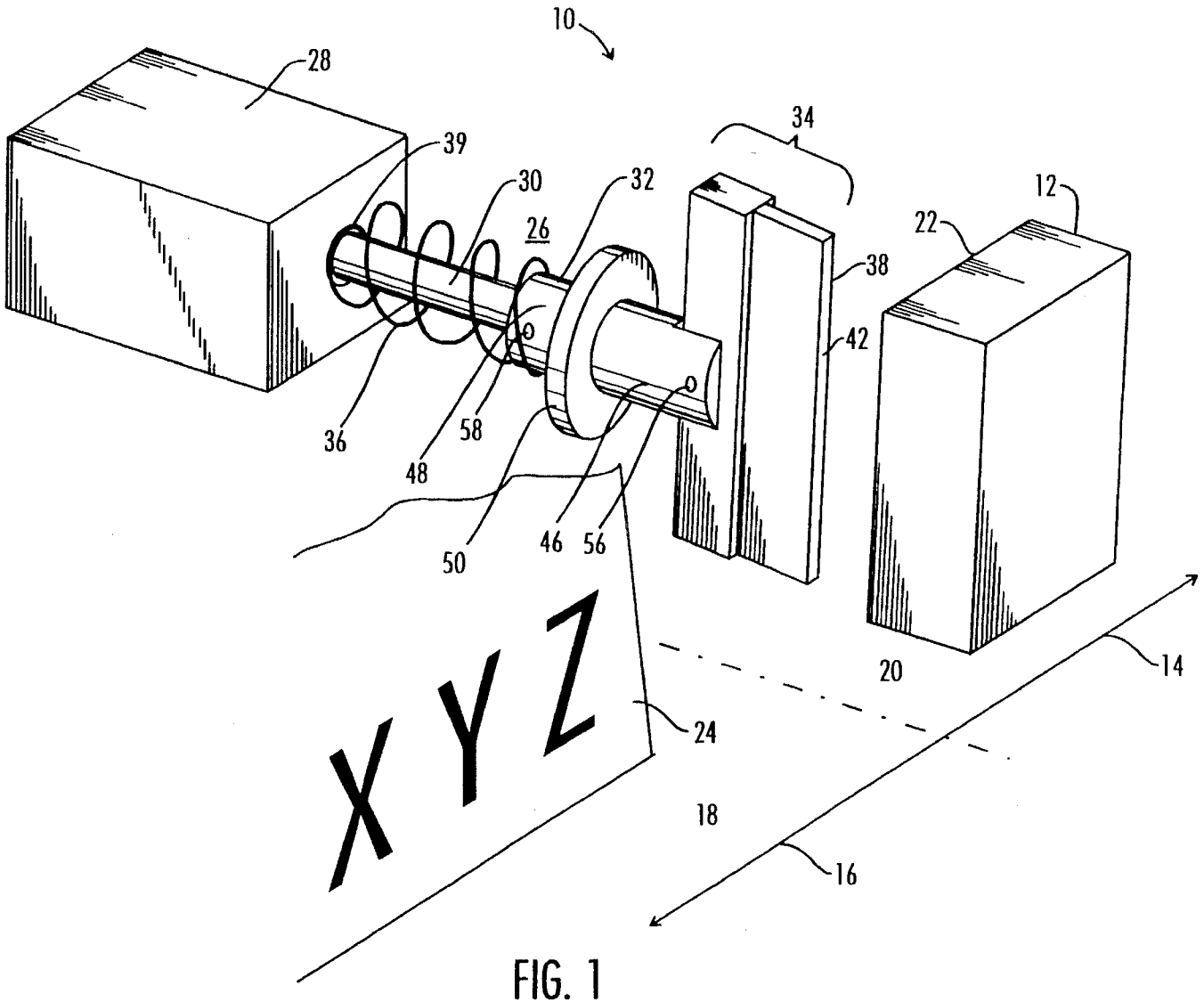
FIG. 1 is a schematic perspective view of a self-aligning cleaning apparatus in accordance with one embodiment of the present invention.
Figure 2:
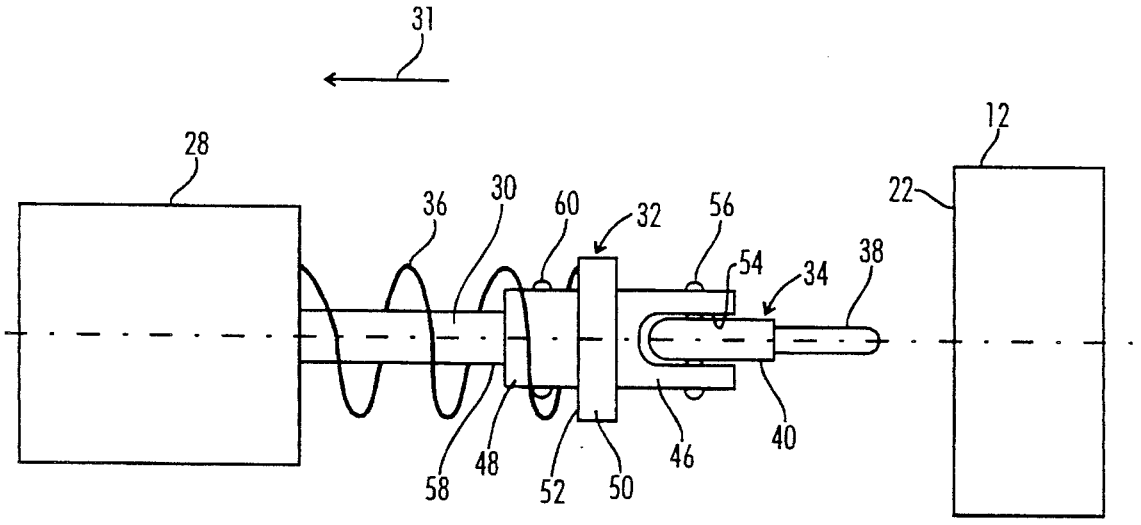
FIG. 2 is a plan view of the self-aligning cleaning apparatus shown in FIG. 1.

Portions of an ink jet apparatus, in accordance with one embodiment of the present invention, are shown in FIGS. 1 and 2. The illustrated ink jet apparatus, generally represented by the numeral 10, includes a recording head 12. The recording head 12 is driven by suitable drive means (not shown) to reciprocate in the directions of arrows 14 and 16 in a recording area 18 and a non-recording area 20.

Figure 4:
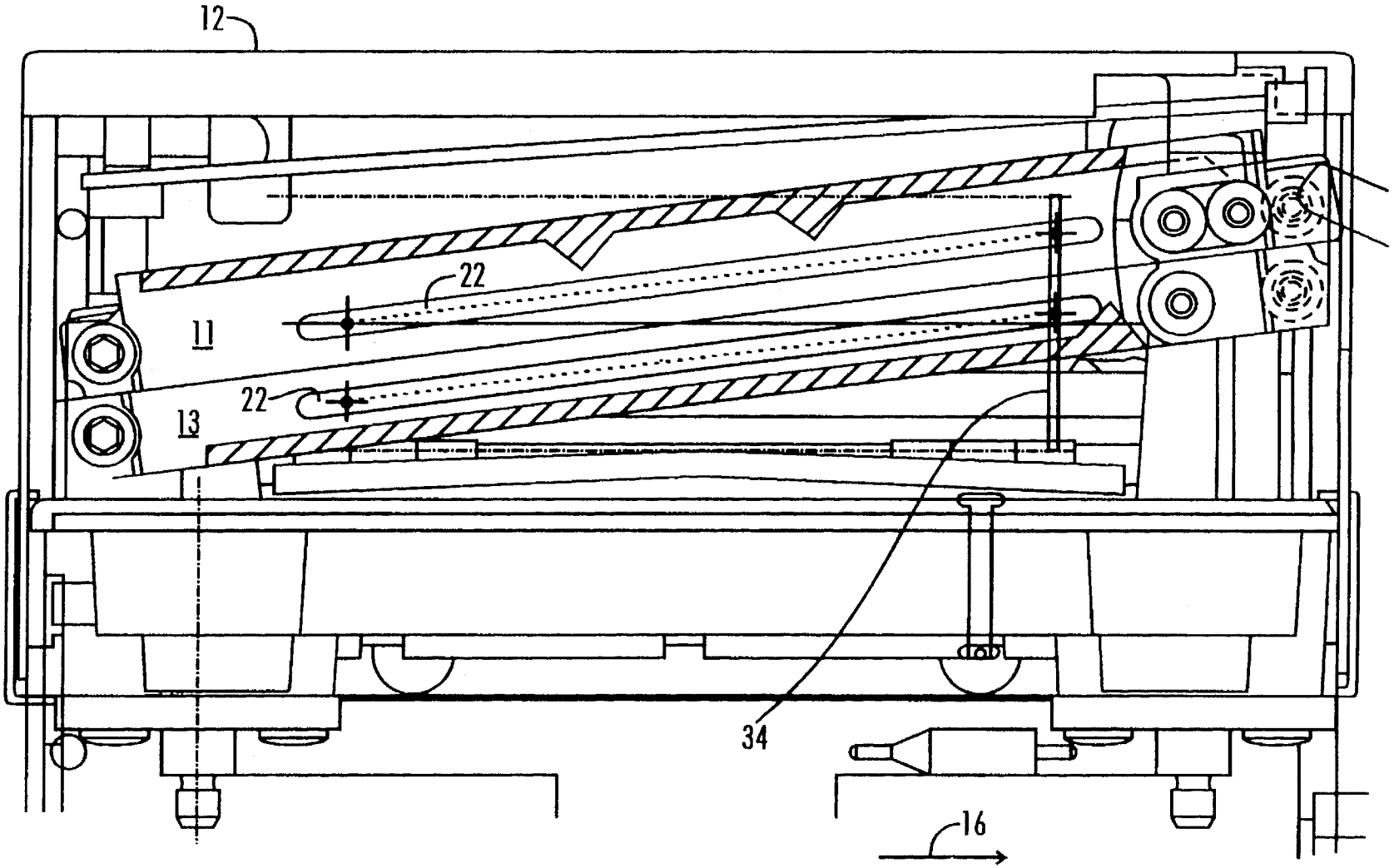
FIG. 4 is a front view of a recording head and wiper arrangement according to an embodiment of the invention.

The recording head 12 has a pair of jetpacks 11 and 13, each of which is provided with an orifice plate having at least one row of orifices along a jetting surface (or orifice surface) 22. The orifices along the ink jetting surface 22 define a plurality of ink discharge ports for jetting ink droplets therethrough. In operation, the recording head 12 scans across the surface of a print media 24 in the recording area 18 for recording on the print media 24. As best shown in FIG. 4, each row of orifices is provided at an angle with respect to the direction of motion of the recording head. The angle of the row of orifices is selected for proper ink dot registration, in accordance with well known principles.

The ink jet apparatus 10 has a self-aligning cleaning apparatus 26 for wiping and cleaning the ink jetting surface 22. In a preferred embodiment, the self-aligning cleaning apparatus 26 is positioned in the non-recording area 20 so that a cleaning process (as described in more detail below) may be carried out in a manner which does not interrupt the printing process.

The self-aligning cleaning apparatus 26 includes a solenoid actuator 28 which has a moveable plunger 30. The solenoid actuator 28 may be selectively actuated to move the plunger 30 in the direction of arrow 31. A double-pivot joint adaptor 32 is pivotally coupled to one end of the plunger 30. The double-pivot joint adaptor 32 is further pivotally coupled to a blade member housing 34. A coil spring member 36 is provided between the solenoid actuator 28 and the blade member housing 34 and biases the blade member housing 34 toward the ink jetting surface 22. The blade member housing 34 includes a blade member 38 which is adapted to come in contact with the jetting surface 22 to wipe and clean residual ink and dusts and other debris off the jetting surface. The blade member housing 34 also includes a blade member support 40 which supports the blade member 38.

Preferably, the blade member 38 is made of a material which is compatible with ink (or other material to be jetted), is high temperature and chemical resistant and holds up well to prolonged mechanical-wear. In preferred embodiments, the blade member 38 is made of flexible silicone rubber and/or other elastomeric materials which are abrasion resistant, weather-resistant and chemically stable.

The blade member 38 has a distal edge 42 which comes into contact with the ink jetting surface 22, upon the blade member 38 being moved toward the cleaning position. In preferred embodiments, the edge 42 is rounded so as to avoid sharp corners. This rounded edge configuration tends to prolong the blade life. It has been found that sharp corners tend to become worn and tattered over a period of use, due to the mechanical wear. However, while preferred embodiments employ a rounded edge configuration, the edge 42 in further embodiments may have any suitable cross-sectional shapes.

In the illustrated embodiment of the present invention, the double-pivot joint adaptor 32 has a blade side member 46 which is adapted to be coupled to the blade member housing 34 and a plunger side member 48 which is adapted to be coupled to the plunger 30. A flange member 50 is provided between the blade side member 46 and the plunger side member 48. The flange member 50 preferably has a diameter larger than that of the coil spring member 36 so that the coil spring member abuts and is retained by the end face 52 of the flange member. As best shown in FIG. 2, the blade member housing 34 is received in a slit 54 provided in the blade side member 46. A pin 56 pivotally couples the blade member housing 34 to the blade side member 46 of the double-pivot joint adaptor 32. A second pin 60 pivotally couples an end 58 of the plunger 30 is to the plunger side member 48 of the double-pivot joint adaptor 32. The double-pivot joint adaptor 32, therefore, provides two pivotal links for allowing rotational movement (about the axis of pin 58) of the adaptor 32 with respect to the plunger 30 and rotational movement (about the axis of pin 56) of the blade member housing 34 with respect to the adaptor 32.

In a preferred embodiment, the solenoid actuator 28 is a latching solenoid. Preferably, the latching solenoid 28 is one which, when activated by a pulse, retracts the plunger 30 to a retracted position and latches (or locks) the plunger 30 in the retracted position. Because the coil spring 36 biases the adaptor 32 toward the recording head 12, activation of the solenoid retracts the plunger 30 against the spring force of the coil spring 36.

Once the plunger 30 is latched, no power is required to maintain the plunger 30 at the retracted position. When the solenoid is latched in the retracted position, the solenoid may be further activated, again by a pulse, to release (unlock) the plunger 30. Once the plunger is released (unlocked), the biasing force of the coil spring 36 moves the adaptor 32 toward the recording head 12 and, therefore, moves the blade member 38 to abut and press against the ink jetting surface 22. Preferably, the only force pressing the blade member 38 against the surface 22 is the spring force of the coil spring 36.

In a preferred embodiment of the present invention, the latching solenoid itself does not provide a force to press the blade member 38 against the ink jetting surface 22. As a result, the latching solenoid is provided with a activation pulse only during a transition to and from the head cleaning mode. In this regard, the latching solenoid draws minimal power and is subjected to minimal operational wear.

In a further embodiment, the plunger 30 is retracted into and out of the solenoid housing through an aperture 39 in the solenoid housing, wherein the aperture is larger than the cross-section of the plunger 30. In this manner, the plunger 30 may move, by a limited amount, within the confines of the aperture 39 and the spring 36. This provides a further degree of freedom of movement for the blade member 38, so as to further aid in the automatic alignment of the blade member 38 with the jetting surface 22.

The double-pivot joint adaptor 32 and the biasing pressure of the coil spring 36 provide a floating or semi-floating blade member 38 for applying a uniform wiping force across the ink jetting surface 22 and for self-aligning to the ink Jetting surface 22. As a result of the floating or semi-floating blade member arrangement, the initial alignment between the blade member 38 and the ink jetting surface 22 is substantially automatically achieved upon allowing the force of the coil spring 36 to move the blade member 34 into contact with the surface 22.

In a non-cleaning mode of operation, the blade member 38 may be maintained in a position within the non-recording area 20, separated from the ink jetting surface 22, as shown in FIGS. 1 and 2. The plunger 30 is latched at the retracted position during a non-cleaning mode when cleaning is not required.

Figure 3:
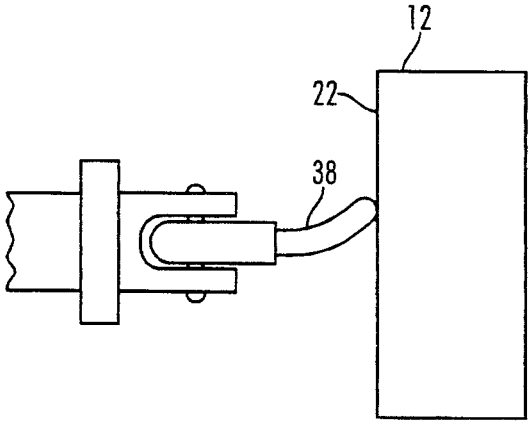
FIG. 3 is a top view of the cleaning blade member in the cleaning position and an ink jet head of the apparatus shown in FIG. 2.

In the cleaning mode of operation, the recording head 12 is moved into the non-recording area 20 and stopped. The latched solenoid 28 is then activated to release the plunger 30. The force of the spring 36 urges the plunger and, thus, the blade member housing 34 toward the recording head 12 to engage the blade member 38 with the ink jetting surface 22, as shown in FIG. 3. Preferably, several seconds later, for example, 5 seconds later, the recording head 12 is accelerated, in the direction of arrow 16, toward the recording area 18. As the recording head 12 passes the blade member 38, the blade member engages the ink jetting surface 22 and wipes ink and other debris off the ink jetting surface.

Figure 5A:
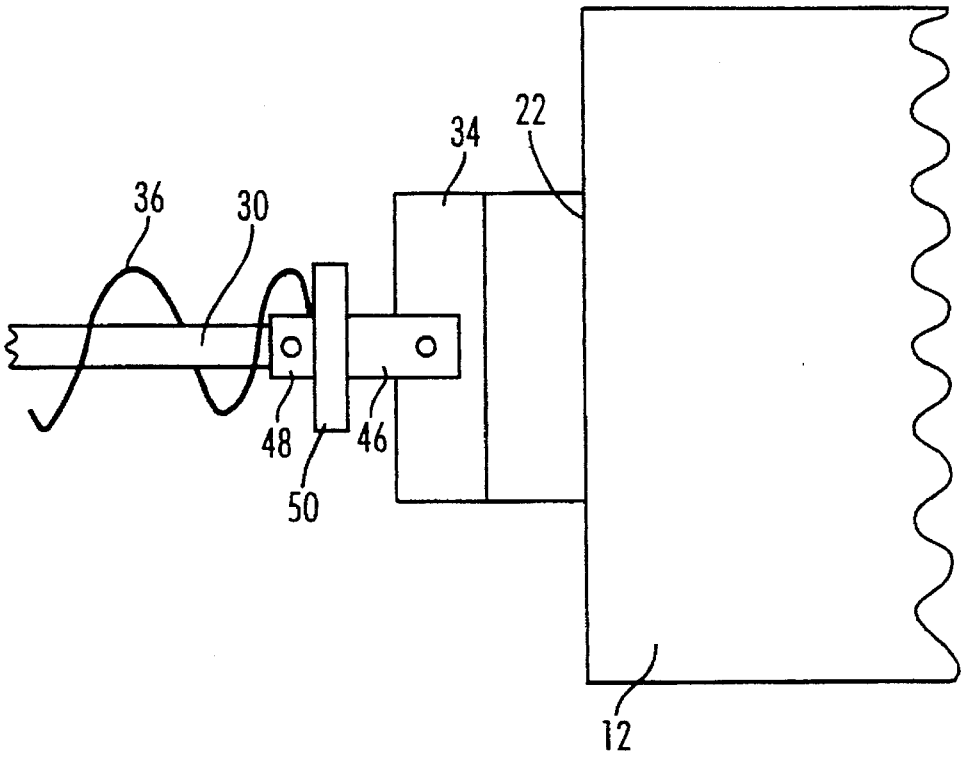
FIGS. 5(*a*) and 5(*b*) are side views of the recording head and wiper arrangement according to the FIG. 4 embodiment.
Figure 5B:
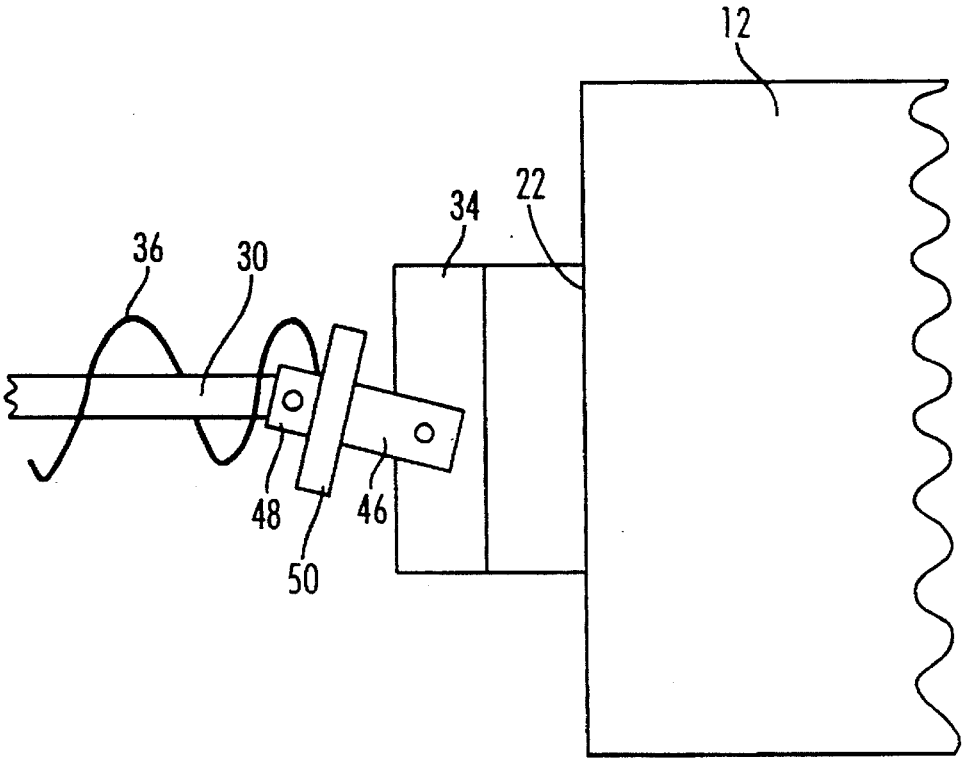

However, when the blade is in contact with an angled jetting surface 22 (angled with respect to the direction of motion of the recording head, as shown in FIG. 4), movement of the recording head imparts a force component on the blade directed transverse to the direction of motion of the recording head. With respect to the embodiment shown in FIG. 4, this force component is directed vertically downward. This force component tends to urge the blade in a direction transverse to the direction of motion of the recording head (downward, in the FIG. 4 embodiment). As discussed below, a self-aligning system allows the blade to remain aligned with the jetting surface, even if the blade moves slightly in a direction transverse to the recording head motion direction. This self-alignment ability is best shown with reference to FIGS. 5(*a*) and 5(*b*), wherein FIG. 5(*b*) shows the blade 38 as having been moved downward with respect to its position in FIG. 5(*a*), yet the distal edge 42 of the blade remains substantially parallel to the plane of the jetting surfaces 22.

It has been found that wiping at high speeds tends to remove air bubbles that may be present near the orifice openings and, thus, tends to increase the effective meniscus formations. In one embodiment, the recording head 12 is accelerated, in the cleaning mode, to a velocity of at approximately 18.7 inches per second, to optimize the wiping and meniscus formation efficiency. At much lower rates, e.g., below 10 inches per second, ink meniscus at the discharge ports may be destroyed and the ink jet apparatus tends to become deprimed.

In one embodiment, the cleaning operation is carried out after recording on a receding medium (A 4 size cut sheets) is completed and before recording on the following recording medium is started. In another embodiment, the cleaning operation may be carried out during the paper feeding operation. As a result, print throughput loss due to the wiping/cleaning operation is minimized.

In still another embodiment, the ink jet apparatus has a controller (not shown) which automatically activates the cleaning apparatus 26 in association with the movement of the recording head 12 and paper feeding operation. It is recognized that very frequent wiping/cleaning operation is not only unnecessary, but also results in a shorter blade life due to mechanical wear. However, too few wiping/cleaning operations would, on the other hand, result in frequent jet outages. Through extensive testing and analysis, it has been recognized that wiping the recording head to remove excess ink and/or debris and to reestablish ink meniscus was optimal when the wiping operation was performed once every X pages of printing, where X was at least 10 pages and at most 30 pages. An approximately 85% confidence level (no ink jet outages 85% of the time) was achieved when the wiping operation was performed once every approximately 30 pages. An approximately 95% confidence level (no ink jet outages 95% of the time) was achieved when the wiping operation was performed once every approximately 10 pages. An approximately 90% confidence level (no ink jet outages 90% of the time) was achieved when the wiping operation was performed once every approximately 25 pages. The latter figure (i.e., once every 25 pages) is preferred, because it provides a very low jet outage rate, with minimal solenoid actuation and wiper wear.

Thus, it has been recognized that the cleaning operation at a wiping frequency ranging between once every 10 pages and once every 30 pages would substantially prevent pooling of ink on the ink jetting surface 22. At this wiping/cleaning frequency range, very little residual ink accumulates on the blade member 38. Therefore, an ink waste collector is not required, and the blade member 38 itself may never require cleaning. In a more preferred embodiment, the cleaning operation is carried out once every 25 pages of A 4 cut sheets.

In tests conducted with the cleaning operation carried out once every 25 pages, printing performances with less than 1 jet outage per 1,000 pages printed were achieved. The test results also confirm that almost 100% of missing jets have been recovered. As a result, except for print initiation procedures, head tending operation (for example, by purging inks or head tending media) has been substantially eliminated.

Accordingly, in preferred embodiments, the controller (not shown) controls the actuation of the cleaning apparatus to effect a wiping operation once every X pages, wherein $10 \leqq X \leqq 30$ and, wherein X is preferably 25. In further embodiments, the controller may be programmed through a suitable user interface (not shown), e.g., keypad or the like, provided on the printer, to effect a wiping operation at any desired time or page number interval. In addition, a user may operate the controller, through the user interface, to effect an immediate wiping operation.

Other embodiments are also possible, their specific designs depending upon the particular application. As such, the scope of the invention should not be limited by the particular embodiment herein described but should be defined only by the appended claims and equivalents thereof.

We claim:

1. In an ink jet apparatus including a recording head having a jetting surface, the jetting surface defining therein a discharge port for ejecting ink therethrough and cleaning apparatus for cleaning the jetting surface, the improvement wherein the cleaning apparatus comprises:

a cleaning blade having an elongated edge for contacting the jetting surface;

a blade support structure supporting the cleaning blade, the blade support structure including a plunger moveable between extended and retracted positions;

a pivotal joint pivotally coupling the cleaning blade to the blade support structure to allow the cleaning blade to pivot to a position in which the elongated edge of the cleaning blade is substantially parallel with the plane of the jetting surface, upon the cleaning blade contacting the jetting surface;

wherein the pivotal joint comprises an adaptor body, a first pivot link coupling the cleaning blade to the adaptor body and a second pivot link coupling the adaptor body to the plunger.

2. An ink jet apparatus according to claim 1, wherein the first pivot link defines a first pivot axis and the second pivot link defines a second pivot axis, the first and second pivot axis being substantially perpendicular to the elongated cleaning edge of the cleaning blade.

3. An ink jet apparatus according to claim 1, wherein the first pivot link defines a first pivot axis and the second pivot link defines a second pivot axis, the first and second pivot axis being substantially parallel.

4. In an ink jet apparatus including a recording head having a jetting surface the jetting surface defining therein a discharge port for ejecting ink therethrough and cleaning apparatus for cleaning the jetting surface, the improvement wherein the cleaning apparatus comprises:

a cleaning blade having an elongated edge for contacting the jetting surface;

a blade support structure supporting the cleaning blade;

a pivotal joint pivotally coupling the cleaning blade to the blade support structure to allow the cleaning blade to pivot to a position in which the elongated edge of the cleaning blade is substantially parallel with the plane of the jetting surface, upon the cleaning blade contacting the jetting surface;

wherein the blade support structure includes a solenoid having a plunger moveable between extended and retracted positions and a spring member coupled to the plunger for urging the plunger toward the plunger's extended position;

wherein the solenoid has latching means selectively actuable for drawing the plunger to the plunger's retracted position and latching the plunger in the plunger's retracted position and means selectively actuable for releasing the plunger from the plunger's latched retracted position so as to allow the spring to move the plunger to the plunger's extended position; wherein the spring urges the plunger to the plunger's extended position and urges the cleaning blade against the jetting surface upon the plunger being released by the solenoid.

5. An ink jet apparatus according to claim 4, wherein the recording head is movable between a recording area and a non-recording area, and wherein the cleaning blade is positioned in the non-recording area.

6. An ink jet apparatus according to claim 4, wherein the elongated edge of the cleaning blade is rounded.

7. A head cleaning device for an ink jet apparatus recording head provided with a jetting surface defining therein at least one discharge port for ejecting ink therethrough, the cleaning device comprising:

a cleaning blade having an elongated edge for contacting the jetting surface;

a blade support structure supporting the cleaning blade, the blade support structure including a plunger moveable between extended and retracted positions;

a pivotal joint pivotally coupling the cleaning blade to the blade support structure to allow the cleaning blade to pivot to a position in which the elongated edge of the cleaning blade is substantially parallel with the plane of the jetting surface, upon the cleaning blade contacting the jetting surface;

wherein the pivotal joint comprises an adaptor body, a first pivot link coupling the cleaning blade to the adaptor body and a second pivot link coupling the adaptor body to the plunger.

8. A head cleaning device according to claim 7, wherein the first pivot link defines a first pivot axis and the second pivot link defines a second pivot axis, the first and second pivot axis being substantially perpendicular to the elongated edge of the cleaning blade.

9. A head cleaning device according to claim 7, wherein the first pivot link defines a first pivot axis and the second pivot link defines a second pivot axis, the first and second pivot axis being substantially parallel.

10. A head cleaning device for an ink jet apparatus recording head provided with a jetting surface defining therein at least one discharge port for ejecting ink therethrough, the cleaning device comprising:

a cleaning blade having an elongated edge for contacting the jetting surface;

a blade support structure supporting the cleaning blade;

a pivotal joint pivotally coupling the cleaning blade to the blade support structure to allow the cleaning blade to pivot to a position in which the elongated edge of the cleaning blade is substantially parallel with the plane of the jetting surface, upon the cleaning blade contacting the jetting surface;

wherein the blade support structure includes a solenoid having a plunger moveable between extended and retracted positions and a spring member coupled to the plunger for urging the plunger toward the plunger's extended position;

wherein the solenoid has latching means selectively actuable for drawing the plunger to the plunger's retracted position and latching the plunger in the plunger's retracted position and means selectively actuable for releasing the plunger from the plunger's latched retracted position so as to allow the spring to move the plunger to the plunger's extended position;

wherein the spring urges the plunger to the plunger's extended position and urges the cleaning blade against the jetting surface upon the plunger being released by the solenoid.

11. A head cleaning device according to claim 10, wherein the recording head is movable between a recording area and a non-recording area, and wherein the cleaning blade is positioned in the non-recording area.

12. A head cleaning device according to claim 11, wherein the elongated edge of the cleaning blade is rounded.

13. A method of cleaning the jetting surface of the recording head of an ink jet apparatus having a recording head provided with a jetting surface, the jetting surface defining therein a discharge port for ejecting ink therethrough, wherein the recording head is movable between a recording area and a non-recording area, and wherein the method comprises the steps of:

moving the recording head into the non-recording area;

resiliently pressing the cleaning blade against the jetting surface of the recording head;

continuously self-aligning the edge of the blade substantially in parallel with the jetting surface while the cleaning blade is being resiliently pressed against the jetting surface; and moving the recording head toward the recording area so as to effect a wiping action of the cleaning blade across the jetting surface;

wherein the ink jet apparatus includes activating means having a plunger pivotally connected to the cleaning blade and a spring member coupled to the plunger, the method further including the steps of:

selectively activating the activating means to free the plunger so that the spring member moves the blade toward the jetting surface and resiliently presses the blade against the jetting surface;

selectively activating the activating means to retract the plunger against the force of the spring member; and latching the plunger at the retracted position.

14. A method of cleaning the jetting surface of the recording head of an ink jet apparatus having a recording head provided with a jetting surface, the jetting surface defining therein a discharge port for ejecting ink therethrough, wherein the recording head is movable between a recording area and a non-recording area, and wherein the method comprises the steps of:

moving the recording head into the non-recording area;

resiliently pressing the cleaning blade against the jetting surface of the recording head;

continuously self-aligning the edge of the blade substantially in parallel with the jetting surface while the cleaning blade is being resiliently pressed against the jetting surface; and moving the recording head toward the recording area so as to effect a wiping action of the cleaning blade across the jetting surface;

wherein the step of selectively activating the activating means to free the plunger is carried out once every 25 pages of printing on A 4 size cut sheets.

15. A method of cleaning the jetting surface of the recording head of an ink jet apparatus having a recording head provided with a jetting surface, the jetting surface defining therein a discharge port for ejecting ink therethrough, wherein the recording head is movable between a recording area and a non-recording area, and wherein the method comprises the steps of:

moving the recording head into the non-recording area;

resiliently pressing the cleaning blade against the jetting surface of the recording head;

pivotally supporting the cleaning blade with the adaptor body at a first pivot link;

continuously self-aligning the edge of the blade substantially in parallel with the jetting surface while the cleaning blade is being resiliently pressed against the jetting surface;

pivotally supporting the solenoid plunger with the adaptor body at a second pivot link so that the solenoid plunger remains in the same position; and moving the recording head toward the recording area so as to effect a wiping action of the cleaning blade across the jetting surface.

16. A method of cleaning the jetting surface of the recording head of an ink jet apparatus according to claim 15, wherein the first pivot link defines a first pivot axis and the second pivot link defines a second pivot axis, the first and second pivot axis being substantially perpendicular to the elongated edge of the cleaning blade.

17. A method of cleaning the jetting surface of the recording head of an ink jet apparatus according to claim 15, wherein the first pivot link defines a first pivot axis and the second pivot link defines a second pivot axis, the first and second pivot axis being substantially parallel.

* * * * *